US006578306B1

(12) United States Patent
Davis, Jr.

(10) Patent No.: US 6,578,306 B1
(45) Date of Patent: Jun. 17, 2003

(54) APPARATUS AND METHOD FOR DISPLAYING OBJECTS

(76) Inventor: Robert E. Davis, Jr., 4846 Spaniel Ct., Concord, CA (US) 94521

( * ) Notice: Subject to any disclaimer, the term of this patent is extended or adjusted under 35 U.S.C. 154(b) by 0 days.

(21) Appl. No.: 10/002,019

(22) Filed: Nov. 15, 2001

(51) Int. Cl.[7] ..... A47G 1/06
(52) U.S. Cl. ..... 40/800; 40/768; 206/533; 206/483
(58) Field of Search ..... 40/800, 732, 768, 40/777, 745; 206/6.1, 553, 483

(56) References Cited

U.S. PATENT DOCUMENTS 3,236,368 A * 2/1966 Eisen ..... 40/800
3,280,972 A 10/1966 Thomas
3,769,730 A * 11/1973 Dole ..... 40/732
3,792,543 A * 2/1974 Powell ..... 40/800
4,787,516 A 11/1988 Morrison
4,794,714 A * 1/1989 Weisgerber ..... 40/768
4,905,821 A 3/1990 Corbett
4,923,069 A 5/1990 Germain et al.
5,118,171 A 6/1992 Ortiz
D329,333 S 9/1992 Ackenett
5,188,222 A * 2/1993 Pierce ..... 206/6.1
5,419,063 A 5/1995 Lane

FOREIGN PATENT DOCUMENTS

EP 0666554 A1 8/1995

* cited by examiner

*Primary Examiner*—Gary Hoge
(74) *Attorney, Agent, or Firm*—Thomas R. Lampe

(57) ABSTRACT

Display apparatus for displaying objects includes a display panel including a panel layer formed of a penetrable, stiff material sandwiched between a layer formed of a penetrable, flexible sheet material and a layer formed of mesh material. The objects are held in position by wires looping about the objects and extending through the display panel.

10 Claims, 3 Drawing Sheets

APPARATUS AND METHOD FOR DISPLAYING OBJECTS

TECHNICAL FIELD

This invention relates to a system for displaying one or more objects, for example for decorative purposes.

BACKGROUND OF THE INVENTION

Many arrangements are known in the prior art for supporting and displaying objects on a panel. The following United States patents illustrate a number of devices which are believed to be representative of the current state of the prior art in this field: U.S. Pat. No. 4,905,821, issued Mar. 6, 1990, U.S. Pat. No. 4,787,516, issued Nov. 29, 1988, U.S. Pat. No. 4,923,069, issued May 8, 1990, U.S. Pat. No. 5,118,171, issued Jun. 2, 1992, U.S. Pat. No. 3,280,972, issued Oct. 25, 1966, U.S. Pat. No. 5,419,063, issued May 30, 1995, U.S. Pat. No. DES.329,333, issued Sep. 15, 1992. Published European Patent Application 0666554A1 also discloses a display device for objects, the arrangement being of particular note in that it incorporates a display board having a wire mesh at the front thereof to enable the displayed material alternatively to be held by either penetrating members, such as tacks, or magnets.

DISCLOSURE OF INVENTION

The present invention relates to both an apparatus and method employed to display objects. The apparatus is characterized by its ability to support objects of varying sizes and shapes. Furthermore, the structure of the apparatus enables even heavy objects to be supported and displayed in a secure manner. Furthermore, the apparatus itself enhances the decorative presentation of the objects displayed. The combination of structural elements and method steps disclosed and claimed herein are not employed in the known prior art.

The display apparatus of the invention is for displaying at least one object. The display apparatus includes a display panel having a first panel layer, a second panel layer and a third panel layer.

The first panel layer and the third panel layer are spaced from one another and located at opposed sides of the second panel layer.

The first panel layer is for engagement by a mounted object and is formed of a penetrable, flexible sheet material. The second panel layer is formed of a penetrable, stiff material, and the third panel layer is formed of mesh material. An object is held in place on the display panel by a wire extending through the display panel and forming a loop clamping the object to the display panel when the two free ends of the wire are attached together.

The method of displaying an object in accordance with the teachings of the present invention includes positioning the object adjacent to a display panel having a first panel layer formed of penetrable, flexible sheet material, a second panel layer formed of penetrable, stiff material and a third panel layer formed of mesh material, the second panel layer being positioned between the first and third panel layers.

The object is brought into engagement with the first panel layer at a selected position on the first panel layer.

Ends of a wire are placed on opposed sides of the object and the ends penetrate the display panel.

The ends of the wire are located beyond the third panel layer.

During the penetrating step, the object is confined within a loop formed by the wire projecting from the first panel layer. The ends of the wire are attached to prevent separation of the wire from the display panel and to maintain the object clamped in the selected position on the first panel layer between the wire and the display panel.

Other features, advantages and objects of the present invention will become apparent with reference to the following description and accompanying drawings.

BEST MODE FOR CARRYING OUT THE INVENTION

Figure 1:
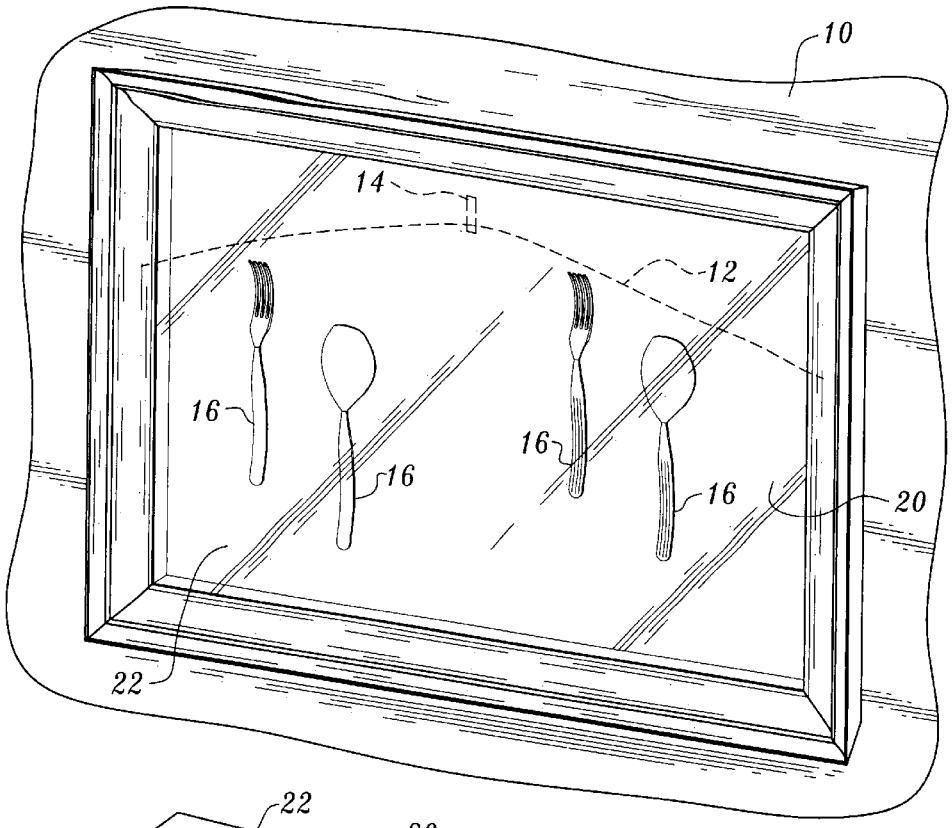
FIG. 1 is a frontal, perspective view illustrating display apparatus constructed in accordance with the teachings of the present invention hung on a wall and displaying four objects.

Referring now to FIG. 1, apparatus constructed in accordance with the teachings of the present invention is supported on a wall 10 in a conventional manner, employing a hanging wire 12 and a frame support 14 of conventional construction. Objects 16 in the form of forks and spoons are being displayed. These particular objects are merely representative of the many types of objects which can be displayed.

The display apparatus includes a display panel 20. Display panel 20 has multiple layers. A first panel layer 22 is a penetrable, flexible sheet material, preferably cloth, which is employed to provide an attractive background for display of the objects.

The display panel also includes a second panel layer 24 formed of a penetrable, stiff material, the second panel layer suitable being a foamed plastic board.

A third panel layer 26 is an open mesh material, suitably metal wire mesh or plastic mesh. The first panel layer and the third panel layer are spaced from one another and located at opposed sides of the second panel layer.

Figure 3:
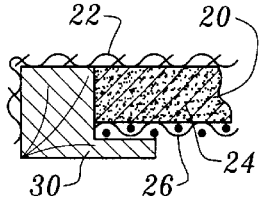
FIG. 3 is a greatly enlarged cross-sectional view illustrating a portion of the display panel and associated inner frame element.

Display panel 20 is positioned in an inner frame element 30 suitably formed of wood, although other types of materials can be utilized. In the arrangement illustrated, the first panel layer 22, as may perhaps best be seen in FIG. 3, extends over and along the sides of inner frame element 30. Together, the inner frame element and the attached first, second and third panel layers form a unitary structure. Any suitable means such as glue, nails or other mechanical fasteners may be utilized to secure the inner frame element to the display panel.

Figure 2:
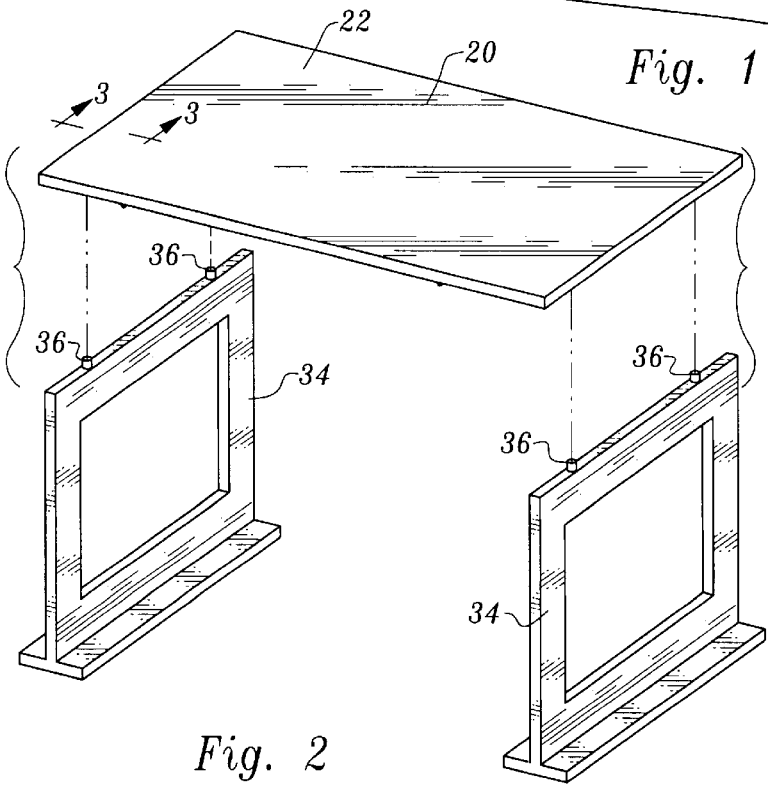
FIG. 2 is an exploded view illustrating the display panel of the apparatus prior to positioning thereof on two support members.
Figure 4:
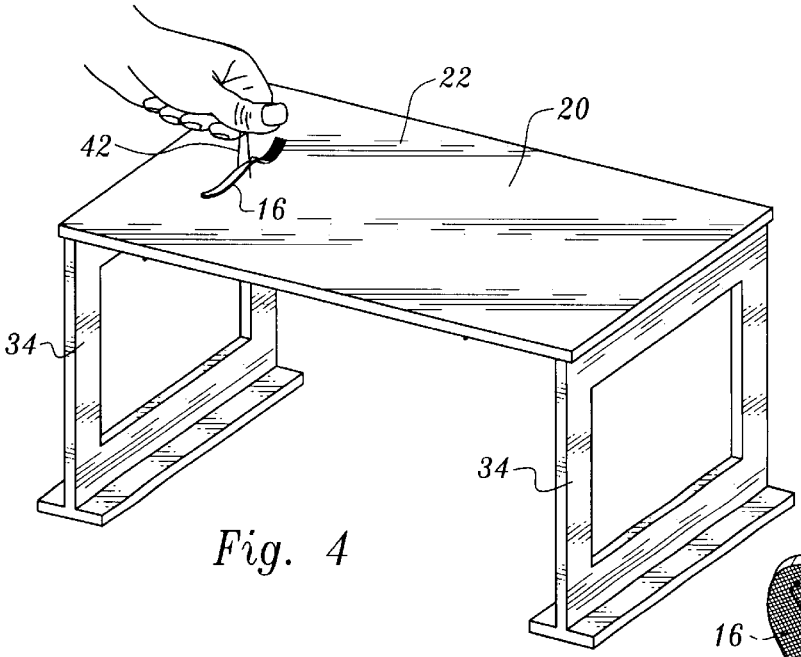
FIG. 4 is a perspective view showing the display panel in position on the support members and a double-ended wire forming a loop placed over an object to be displayed and prior to penetration of the wire into and through the display panel.

FIG. 2 shows the display panel 20 being applied to support members 34 which are utilized as a support to support the display panel in an elevated and horizontal condition, as shown in FIG. 4. Projections 36 at the tops of the support members 34 are positioned in correspondingly sized holes 38 (see FIG. 9) formed at opposed ends of the inner frame. This maintains the display panel and inner frame element in a stable condition to perform the work of installing the objects to be displayed, as will now be described.

Figure 5:
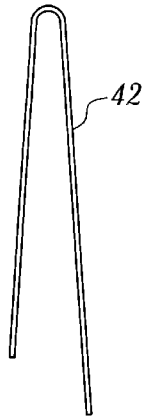
FIG. 5 is a greatly enlarged, side elevational view of the double-ended wire employed to attach an object to the display panel.
Figure 6:
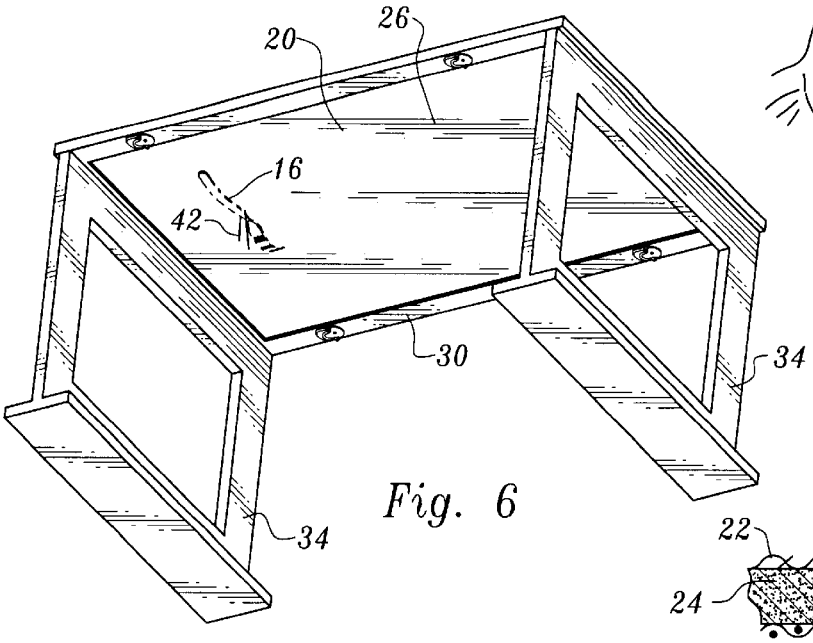
FIG. 6 is a bottom perspective view of the display panel and the support members, showing the displayed object in phantom and the wire penetrating the display panel.

FIG. 4 shows the display panel extending between the support members 34, first panel layer 22 disposed upwardly. An object in the form of fork 16 has been positioned over the display panel and then brought into engagement with the first panel layer at a selected position on the first panel layer. The individual mounting fork 16 has in her or his hand a curved wire 42, FIG. 5 providing a more detailed illustration of the wire. The downwardly extending ends of the wire 42 are placed on opposed sides of object 16, as shown. Next, the individual pushes the wire in a downward direction to penetrate the display panel with the ends of the wire. As shown in FIG. 6, this locates the ends of the wire beyond the third panel layer.

The upper end of the wire 42 forms a loop which projects upwardly from the first panel layer over the object 16.

Figure 7A:
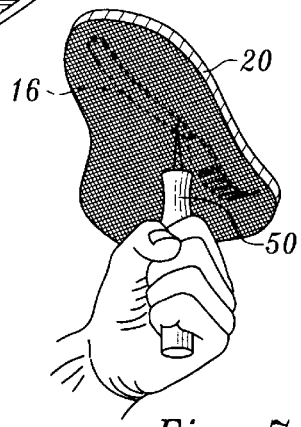
FIG. 7A illustrates a portion of the display panel as seen from the bottom thereof with projecting ends of the wire employed to hold an object in place on the display panel being twisted together with a tool.
Figure 7B:
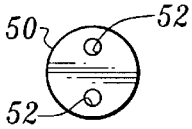
FIG. 7B is an end view of the tool shown in FIG. 7A employed to twist the wire.
Figure 8:
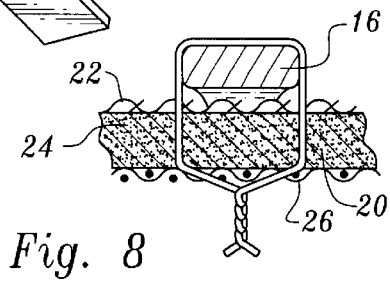
FIG. 8 is a cross-sectional view of a portion of the display panel showing the wire with twisted ends clamping the object to be displayed between the wire and the display panel.

As shown in FIGS. 7A, 7B, the individual then employs a tool 50 to twist the ends of the bent wire. The tool is simply a manually graspable member having two openings 52 at the upper end thereof which receive the wire ends. After the wire ends are inserted into the holes 52, the individual turns the tool 50 to twist the wire ends together, resulting in the interconnection thereof as shown in FIG. 8. Twisting the ends of the wire causes the wire to exert compressive forces on the third panel layer. Also, the object 16 is clamped in the selected position on the first panel layer between the wire and the display panel, the loop of the wire changing configuration in the process of twisting of the wire ends to conform to the shape of the object being clamped into position. It will be appreciated that the same procedure as outlined above is utilized with each object mounted on the display panel.

Figure 9:
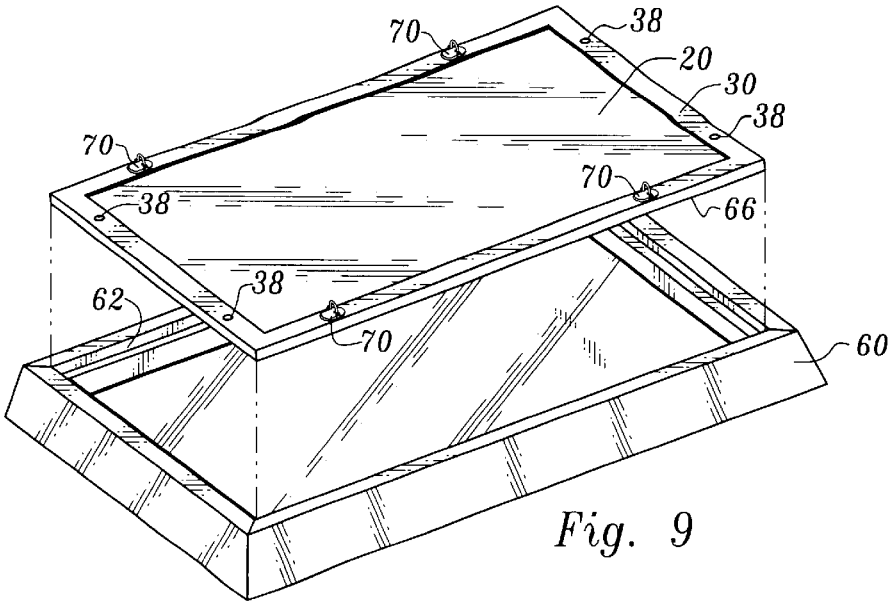
FIG. 9 is an exploded, perspective view illustrating the panel and inner frame element associated therewith prior to positioning in an outer frame element.

Another component of the display apparatus is an outer frame element 60 which defines a recess 62 for receiving the display panel, the inner frame element and any objects attached to that unitary structure. FIG. 9 shows the display panel and inner frame element prior to positioning thereof on the outer frame element.

The outer frame element 60 has an inner peripheral wall 64 and the inner frame element 30 has an outer peripheral wall 66. When the inner frame element is disposed within the outer frame element, walls 64, 66 are closely adjacent to and face one another.

Figure 10:
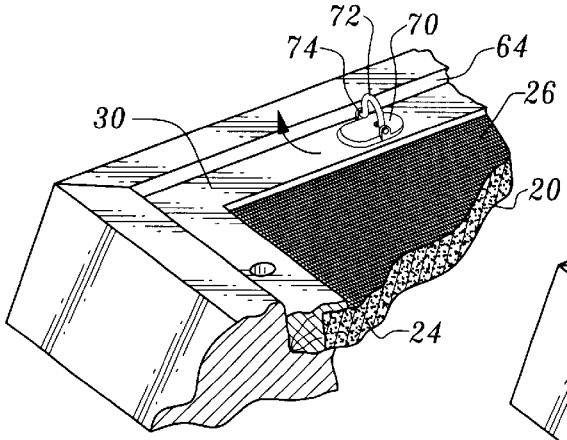
FIGS. 10–12 are perspective views of the display panel and inner and outer frame elements illustrating sequential positioning of a cam lock relative thereto when securing the outer and inner frame elements together.
Figure 11:
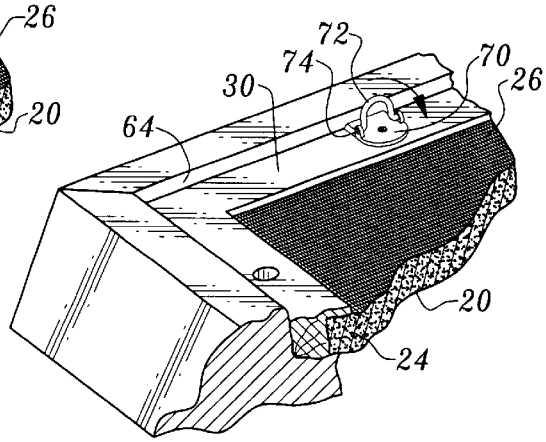
Figure 12:
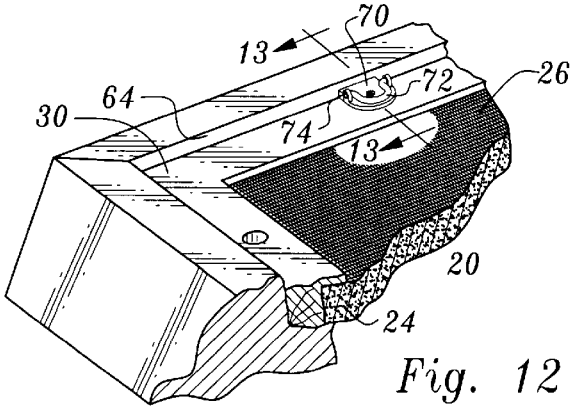

A plurality of cam locks 70 are rotatably mounted on the inner frame element 30. A handle 72 associated with each rotatable cam lock can be used to manually rotate same as shown in FIGS. 10–12 to cause the cams to lockingly engage the outer frame element and maintain the inner frame element and the outer frame element in fixed position relative to one another.

Each cam lock has an outer cam surface 74 which engages the inner wall 64 of the outer frame element when the frame elements are locked together.

The depth of the recess 62 of the outer frame element is greater than the thickness of the inner frame element and the inner frame element is telescopically adjustable relative to the outer frame element. This is a significant feature which allows the display apparatus to accommodate different sizes or thicknesses of objects to be displayed. This becomes particularly important if a glass pane (not shown) is mounted on the outer frame element over the displayed object. Such a glass pane can be used even for thicker or larger objects since the inner frame element can be moved away from the front of the outer frame element to provide clearance between the glass pane and the object or objects which might otherwise engage the glass pane.

Figure 13:
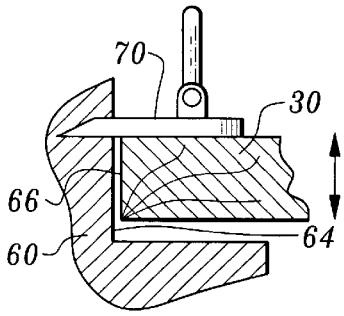
FIG. 13 is an enlarged cross-sectional view taken along the line 13—13 in FIG. 12 showing details of the cam lock interconnection with the inner and outer frame elements.

FIG. 13 illustrates the ability of the inner frame element to move telescopically relative to the outer frame element by means of a double-headed arrow. When the desired position on the inner frame element is reached, the operator merely uses the handles 72 to turn the cam locks and bring the cam surfaces thereof into engagement with the outer frame element to lock the frame elements together. If the outer frame element is constructed of wood, the cam surface 74 will "bite" into the inner wall 64 of the outer frame element to securely lock the frame elements together.

The invention claimed is:

1. Display apparatus for displaying at least one object, said display apparatus including a display panel having a first panel layer, a second panel layer and a third panel layer, said first panel layer and said third panel layer being spaced from one another and located at opposed sides of said second panel layer, said first panel layer for engagement by a mounted object and being formed of a penetrable, flexible sheet material, said second panel layer being formed of a penetrable, stiff material, and said third panel layer being formed of mesh material.

2. The display apparatus according to claim 1 additionally comprising an inner frame element attached to and surrounding said first, second and third panel layers, forming a unitary structure therewith.

3. The display apparatus according to claim 2 additionally comprising an outer frame element surrounding said inner frame element and releasable attachment means for releasably retaining said inner frame element at a predetermined location within said outer frame element.

4. The display apparatus according to claim 1 additionally comprising a wire having two ends and attached to said display panel and extending through said display panel, said two ends being twisted together adjacent to said third panel layer and cooperable with said third panel layer to prevent separation of said wire from said display panel, said wire defining a loop extending outwardly from said first panel layer accommodating the mounted object and maintaining the object at a selected position on the display panel adjacent to said first panel layer.

5. The display apparatus according to claim 3 wherein said releasable attachment means comprises a plurality of cam locks movably mounted on said inner frame element, said cam locks having outer cam surfaces for selectively engaging and bearing against said outer frame element to retain said inner frame element at said predetermined location within the outer frame element.

6. The display apparatus according to claim 5 wherein said inner frame element is telescopically adjustable relative to said outer frame element, an outer wall of said inner frame element being adjacent to an inner wall of said outer frame element, said inner wall of said outer frame element being engageable by the outer cam surfaces of said cam locks to maintain said inner frame element and said outer frame element at selected alternative relative positions.

7. The display apparatus according to claim 1 additionally comprising a support selectively operatively associated with said display panel to maintain said display panel in a substantially horizontal condition and elevated to facilitate installation or removal of one or more objects relative to the display panel.

8. The display apparatus according to claim 1 wherein said first panel layer is cloth.

9. The display apparatus according to claim 1 wherein said second panel layer is a foamed plastic board.

10. The display apparatus according to claim 1 wherein said third panel layer is wire mesh.

* * * * *